US008897686B2

(12) United States Patent
Matsumoto et al.

(10) Patent No.: US 8,897,686 B2
(45) Date of Patent: Nov. 25, 2014

(54) FIXING DEVICE AND IMAGE FORMING APPARATUS

(75) Inventors: Mitsuhiro Matsumoto, Kanagawa (JP); Hiroyoshi Inoue, Kanagawa (JP); Junpei Amano, Kanagawa (JP); Nobuyoshi Komatsu, Kanagawa (JP); Atsumi Kurita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 155 days.

(21) Appl. No.: 13/612,284

(22) Filed: Sep. 12, 2012

(65) Prior Publication Data

US 2013/0236224 A1 Sep. 12, 2013

(30) Foreign Application Priority Data

Mar. 12, 2012 (JP) ..... 2012-054535

(51) Int. Cl.
*G03G 15/20* (2006.01)

(52) U.S. Cl.
USPC ..... 399/329; 399/122; 399/328

(58) Field of Classification Search
CPC ..... G03G 15/2017; G03G 15/2053; G03G 2215/2022; G03G 2215/2029; G03G 2215/2035
USPC ..... 399/122, 328, 329
See application file for complete search history.

(56) References Cited

U.S. PATENT DOCUMENTS

2005/0185996 A1* 8/2005 Oishi et al. ..... 399/329
2009/0074485 A1* 3/2009 Takada ..... 399/329

FOREIGN PATENT DOCUMENTS

JP 2011-123284 A 6/2011

* cited by examiner

*Primary Examiner* — Ryan Walsh
(74) *Attorney, Agent, or Firm* — Sughrue Mion, PLLC

(57) ABSTRACT

A fixing device includes a heat assembly including an endless belt, a heat source, an attachment member having an attachment surface and first and second side surfaces, and a slide sheet having first and second end portions that are respectively fixed to a first fixing portion at the first side surface and a second fixing portion at the second side surface, the slide sheet having a larger length from the first end portion to the second end portion than a length of a path of the attachment member extending from the first fixing portion to the second fixing portion through the first side surface, the attachment surface, and the second side surface; and a pressure roller that presses the outer surface of the endless belt to the attachment surface.

5 Claims, 6 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-054535 filed Mar. 12, 2012.

BACKGROUND

The present invention relates to a fixing device and an image forming apparatus.

SUMMARY

According to an aspect of the invention, there is provided a fixing device including a heat assembly including an endless belt that moves in a circulation manner and has an inner surface and an outer surface, a heat source that heats the endless belt, an attachment member having an attachment surface that is attached to the inner surface of the endless belt, and first and second side surfaces respectively extending from upstream and downstream ends of the attachment surface in a moving direction of a portion of the endless belt moving along the attachment surface so as to extend away from the inner surface of the endless belt, the first side surface having a first fixing portion, the second side surface having a second fixing portion, and the heat assembly also including a slide sheet having first and second end portions that are respectively fixed to the first fixing portion of the first side surface and the second fixing portion of the second side surface, the slide sheet being pinched and extending between the attachment surface of the attachment member and the endless belt, the slide sheet having a larger length from the first end portion to the second end portion than a length of a path of the attachment member extending from the first fixing portion to the second fixing portion through the first side surface, the attachment surface, and the second side surface; and a pressure roller that presses the outer surface of the endless belt to the attachment surface, receives a medium that holds an unfixed toner image between the pressure roller and the endless belt, and fixes the toner image to the medium in cooperation with the heat assembly.

BRIEF DESCRIPTION OF THE DRAWINGS

Exemplary embodiments of the present invention will be described in detail based on the following figures, wherein.

DETAILED DESCRIPTION

Exemplary embodiments are described below with reference to the drawings.

First, a first exemplary embodiment is described.

Figure 1:
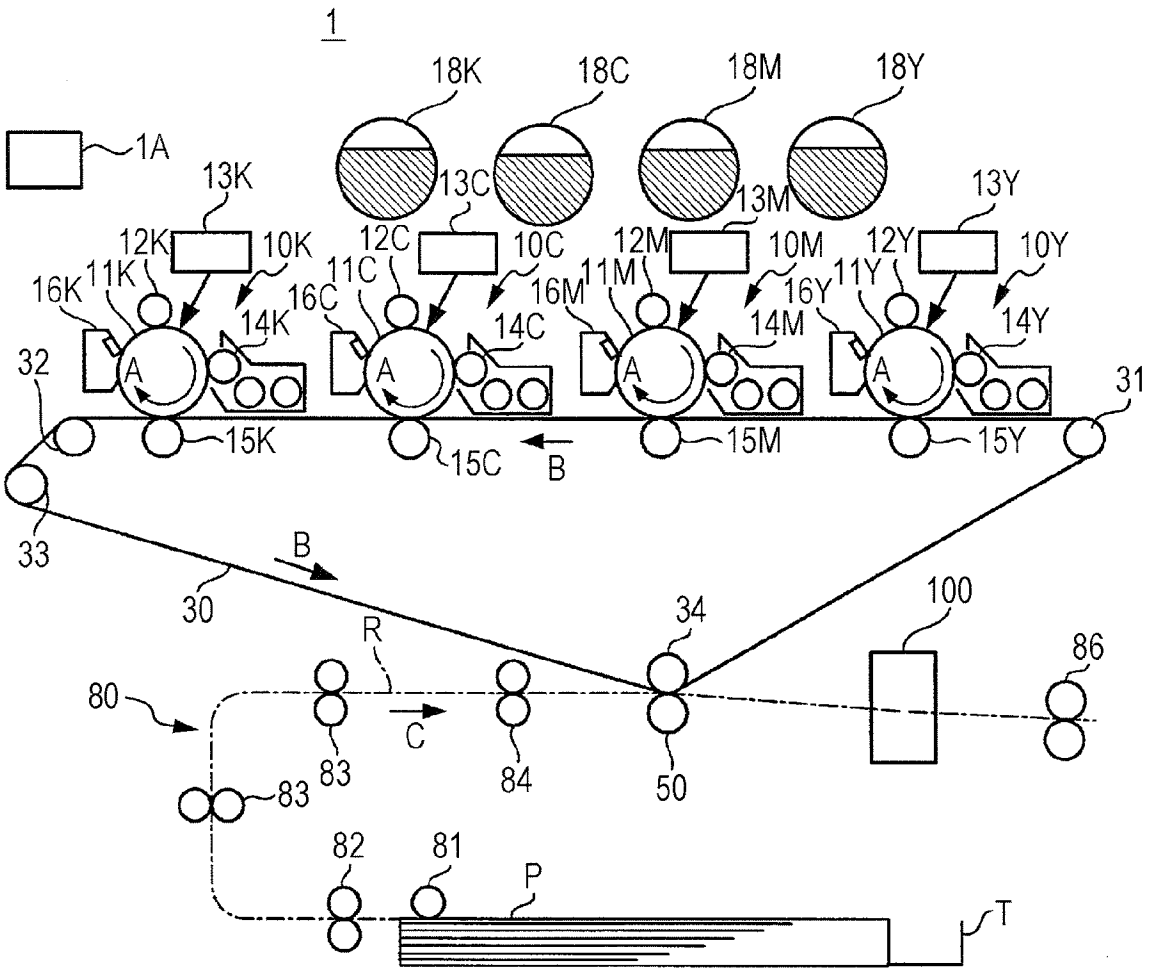
FIG. 1 is a configuration diagram showing an image forming apparatus according to a first exemplary embodiment of the present invention.

FIG. 1 is a configuration diagram showing an image forming apparatus 1 according to the first exemplary embodiment of the present invention.

The image forming apparatus 1 is a tandem color printer in which image forming units 10Y, 10M, 10C, and 10K of respective colors including yellow (Y), magenta (M), cyan (C), and black (K) are arranged in parallel. The image forming apparatus 1 executes printing of an monochrome image, and also executes printing of a full-color image formed of four-color toner images. Toner cartridges 18Y, 18M, 18C, and 18K house toners of the respective YMCK colors. The toners has, for example, an average particle diameter ranging from 2 to 7 μm, and a diameter of an equivalent circle ranging from 0.95 to 1.0. Also, the toner cartridges 18Y, 18M, 18C, and 18K contain a lubricant as an additive of the toners.

The four image forming units 10Y, 10M, 10C, and 10K have configurations being substantially equivalent to each other. Hence, the image forming unit 10Y corresponding to yellow is representatively described. The image forming unit 10Y includes a photoconductor 11Y, a charging unit 12Y, an exposure unit 13Y, a developing unit 14Y, and a first transfer unit 15Y. Also, a photoconductor cleaner 16Y is provided at the image forming unit 10Y. The photoconductor cleaner 16Y cleans the photoconductor 11Y.

The photoconductor 11Y is a drum having a cylindrical base body and a photoconductor layer provided on the surface of the base body. The photoconductor 11Y holds an image that is formed on the surface, and rotates around the axis of the cylinder, i.e., in a direction indicated by arrow A. The charging unit 12Y, the exposure unit 13Y, the developing unit 14Y, the first transfer unit 15Y, and the photoconductor cleaner 16Y are successively arranged around the photoconductor 11Y in the order of the direction indicated by arrow A.

The charging unit 12Y causes the surface of the photoconductor 11Y to be electrically charged. The charging unit 12Y is a charging roller that contacts the surface of the photoconductor 11Y. A voltage with the same polarity as the polarity of the toner in the developing unit 14Y is applied to the charging unit 12Y, and causes the surface of the photoconductor 11Y contacting the charging unit 12Y to be electrically charged. The exposure unit 13Y radiates the photoconductor 11Y with exposure light and hence causes the surface of the photoconductor 11Y to be exposed to the light. The exposure unit 13Y emits laser light in accordance with an image signal supplied from the outside of the image forming apparatus 1, and scans the surface of the photoconductor 11Y with the laser light.

The developing unit 14Y uses a developer and develops the surface of the photoconductor 11Y. The toner is supplied to the developing unit 14Y from the toner cartridge 18Y. The developing unit 14Y stirs the developer in which a magnetic carrier and a toner are mixed, and hence causes the toner and the magnetic carrier to be electrically charged. The developing unit 14Y develops the surface of the photoconductor 11Y with the electrically charged toner. The first transfer unit 15Y is a roller that faces the photoconductor 11Y with an intermediate transfer belt 30 interposed therebetween. The first transfer unit 15Y applies a voltage to the photoconductor 11Y and hence transfers a toner image on the photoconductor 11Y onto the intermediate transfer belt 30.

The photoconductor cleaner 16Y cleans the surface of the photoconductor 11Y by removing the toner (a residual toner) remaining at a portion subjected to the transfer by the first transfer unit 15Y.

The image forming apparatus 1 also includes the intermediate transfer belt 30, a fixing device 100, a sheet transport unit 80, and a controller 1A. The intermediate transfer belt 30 is an endless belt wound around belt support rollers 31 to 34. The intermediate transfer belt 30 moves in a circulation manner in a direction indicated by arrow B that passes through the image forming units 10Y, 10M, 10C, and 10K and a second transfer unit 50. Toner images of the respective colors are transferred on the intermediate transfer belt 30 from the image forming units 10Y, 10M, 10C, and 10K. The intermediate transfer belt 30 moves while holding the toner images of the respective colors.

The second transfer unit 50 is a roller that pinches the intermediate transfer belt 30 and a sheet P between the second transfer unit 50 and a backup roller 34 that is one of the belt support rollers 31 to 34. The second transfer unit 50 applies a voltage that is a reverse polarity being reverse to the charging polarity of the toner and hence transfers the toner images on the intermediate transfer belt 30 onto the sheet P.

A combination of the image forming units 10Y, 10M, 10C, and 10K, the intermediate transfer belt 30, and the second transfer unit 50 corresponds to an example of an image forming unit according to an exemplary embodiment of the present invention.

The fixing device 100 fixes the toner images to the sheet P. The fixing device 100 corresponds to a fixing device according to an exemplary embodiment of the present invention. The fixing device 100 also corresponds to a fixing unit included in an image forming apparatus according to an exemplary embodiment of the present invention. The fixing device 100 is described later in detail.

The sheet transport unit 80 includes a pickup roller 81 that picks up sheets P housed in a sheet housing container T, a separation roller 82 that separates the picked-up sheets P, and a transport roller 83 that transports the separated sheet P. The sheet transport unit 80 further includes a registration roller 84 that transports the sheet P to the second transfer unit 50, and an output roller 86 that outputs the sheet P to the outside. The sheet transport unit 80 transports the sheet P along a sheet transport path R that passes through the second transfer unit 50 and the fixing device 100.

A basic operation of the image forming apparatus 1 shown in FIG. 1 is described. In the image forming unit 10Y corresponding to yellow, the photoconductor 11Y rotates in the direction indicated by arrow A, and the surface of the photoconductor 11Y is electrically charged by the charging unit 12Y. The exposure unit 13Y radiates the surface of the photoconductor 11Y with exposure light in accordance with an image signal corresponding to yellow from among image signals supplied from the outside. Hence, the exposure unit 13Y forms an electrostatic latent image on the surface of the photoconductor 11Y. The developing unit 14Y receives the supply of the yellow toner from the toner cartridge 18Y, and develops the electrostatic latent image on the photoconductor 11Y with the toner. Thus, the developing unit 14Y forms the toner image. The photoconductor 11Y rotates while holding the yellow toner image formed on the surface. The first transfer unit 15Y transfers the toner image formed on the surface of the photoconductor 11Y onto the intermediate transfer belt 30. After the transfer, the photoconductor cleaner 16Y cleans the residual toner remaining on the photoconductor 11Y.

The intermediate transfer belt 30 moves in a circulation manner in the direction indicated by arrow B. The image forming units 10M, 10C, and 10K corresponding to the colors except yellow form toner images corresponding to the respective colors, in a manner similar to the image forming unit 10Y. The toner images of the respective colors are successively transferred on the intermediate transfer belt 30, and superposed on the toner image transferred by the image forming unit 10Y.

The pickup roller 81 picks up a sheet P from the sheet housing container T. The transport roller 83 and the registration roller 84 transport the sheet P through the sheet transport path R in a direction indicated by arrow C toward the second transfer unit 50. The registration roller 84 sends the sheet P to the second transfer unit 50 in accordance with a timing at which the toner images are transferred on the intermediate transfer belt 30. The second transfer unit 50 transfers the toner images on the intermediate transfer belt 30 onto the sheet P. The sheet P with the toner images transferred thereon is transported to the fixing device 100. The fixing device 100 fixes the toner images transferred on the sheet P to the sheet P. In this way, an image is formed on the sheet P. The output roller 86 outputs the sheet P with the image formed thereon to the outside of the image forming apparatus 1.

Next, the fixing device 100 is described.

Figure 2:
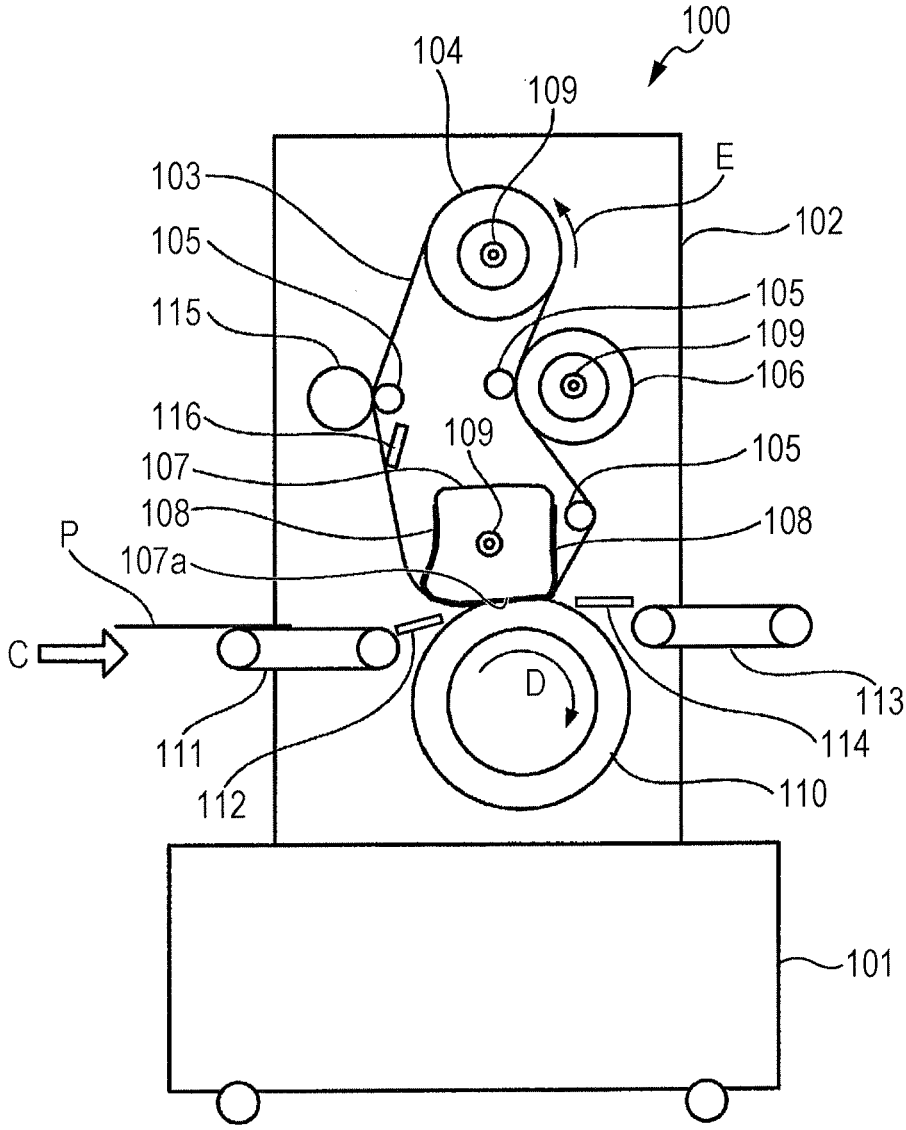
FIG. 2 schematically illustrates a brief inner structure of a fixing device.

FIG. 2 schematically illustrates a brief inner structure of the fixing device 100.

The fixing device 100 includes a base 101, a frame 102, an endless belt 103, a tension roller 104, three positioning rollers 105, an external heat roller 106, a fixing pad 107, and a slide sheet 108.

The fixing device 100 is removably mounted on the image forming apparatus 1 in FIG. 1. The image forming apparatus 1 has a guide frame (not shown) that receives and supports the fixing device 100. The base 101 of the fixing device 100 is removably supported by the guide frame. The frame 102 of the fixing device 100 is constructed on the base 101.

The tension roller 104, the three positioning rollers 105, and the external heat roller 106 are rotatably supported by the frame 102. In contrast, the fixing pad 107 is fixed to the frame 102.

The endless belt 103 is wound around the tension roller 104 and the three positioning rollers 105. Further, the fixing pad 107 is attached to the inner surface of the endless belt 103. The external heat roller 106 is rotatably supported at the frame 102 with the endless belt 103 interposed between the external heat roller 106 and the positioning roller 105 at the upper right side in the drawing from among the three positioning rollers 105.

The endless belt 103 is formed by providing a silicone rubber layer with a thickness ranging from 300 to 600 μm and a release layer with a thickness ranging from 20 to 50 μm on a base member with a thickness ranging from 70 to 100 μm made of polyimide. The release layer is formed of a fluorine resin material, such as perfluoroalkoxy alkane (PFA), having a high release property.

The fixing pad 107 has a substantially rectangular parallelepiped shape extending in a direction orthogonal to the paper face. The fixing pad 107 has an attachment surface 107*a* that is one of side surfaces. The attachment surface 107*a* is attached to the inner surface of the endless belt 103.

Also, the slide sheet 108 is fixed to the fixing pad 107 in a manner described later, while the slide sheet 108 is pinched between the fixing pad 107 and the endless belt 103.

The slide sheet 108 is formed of a fluorine resin material, such as polytetrafluoroethylene (PTFE), which is a low-friction material, to reduce a frictional resistance with respect to the endless belt 103. The slide sheet 108 has a thickness ranging from 200 to 500 μm to reduce a shear force and a creep amount.

Also, heaters 109 that heat the endless belt 103 are respectively provided in the tension roller 104, the external heat roller 106, and the fixing pad 107. The endless belt 103 corresponds to an example of an endless belt according to an exemplary embodiment of the present invention. The fixing pad 107 corresponds to an example of an attachment member according to an exemplary embodiment of the present invention. The heater 109 corresponds to an example of a heat source according to an exemplary embodiment of the present invention.

In the fixing device 100, a pressure roller 110 is rotatably supported at the frame 102 so that the pressure roller 110 presses the outer surface of the endless belt 103 to the attachment surface 107*a* of the fixing pad 107. With the pressure of the pressure roller 110, a nip region for pinching a sheet P is formed between the pressure roller 110 and the endless belt 103 with the attachment surface 107*a* of the fixing pad 107 attached to the inner surface of the endless belt 103.

The pressure roller 110 is rotationally driven in a direction indicated by arrow D by a driving mechanism (not shown in FIG. 2) while the nip region is formed. The pressure roller 110 corresponds to an example of a pressure roller according to an exemplary embodiment of the present invention.

When the pressure roller 110 rotates, the endless belt 103 is driven by the rotation of the pressure roller 110 and moves in a circulation manner in a direction indicated by arrow E. During the circulation movement, the slide sheet 108 slides on the inner surface of the endless belt 103. The slide sheet 108 corresponds to an example of a slide sheet according to an exemplary embodiment of the present invention. A combination of the endless belt 103, the fixing pad 107, the heaters 109, and the slide sheet 108 corresponds to an example of a heat assembly according to an exemplary embodiment of the present invention.

The fixing device 100 includes an entrance-side transport belt 111 that transports a sheet P, which is transported in the direction indicated by arrow C (also shown in FIG. 1) and holds an unfixed toner image, toward the entrance of the nip region. An entrance-side guide portion 112 is arranged between the entrance-side transport belt 111 and the entrance of the nip region. The entrance-side guide portion 112 guides the sheet P to the entrance of the nip region. The entrance-side transport belt 111 and the entrance-side guide portion 112 send the sheet P to the nip region.

The sheet P sent to the nip region is heated by the endless belt 103 heated by the heaters 109, is pressed by the pressure roller 110, and is transported to the exit of the nip region. The toner image held on the sheet P is fixed to the sheet P by the heat and pressure applied from the endless belt 103 and the pressure roller 110 while the sheet P passes through the nip region.

An exit-side transport belt 113 and an exit-side guide portion 114 are arranged at the exit of the nip region. The exit-side transport belt 113 transports the sheet P toward the output roller 86 shown in FIG. 1. The exit-side guide portion 114 guides the sheet P from the exit of the nip region to the exit-side transport belt 113. The sheet P after the toner image is fixed is transported to the output roller 86 by these members.

The fixing device 100 also includes a cleaning roller 115 at a position at which the endless belt 103 is pinched between the cleaning roller 115 and the positioning roller 105 at the left side in the drawing from among the three positioning rollers 105. The cleaning roller 115 removes a foreign substance adhering to the endless belt 103 after fixing of the toner image. Also, an inner-surface cleaning member 116 is arranged between the positioning roller 105 at the left side in the drawing and the fixing pad 107. The inner-surface cleaning member 116 contacts the inner surface of the endless belt 103 and removes a foreign substance, such as wear powder, adhering to the inner surface of the endless belt 103. The inner-surface cleaning member 116 is impregnated with a lubricant to reduce friction between the inner surface of the endless belt 103 and the slide sheet 108 etc. The inner-surface cleaning member 116 also applies the lubricant to the inner surface of the endless belt 103.

Figure 3:
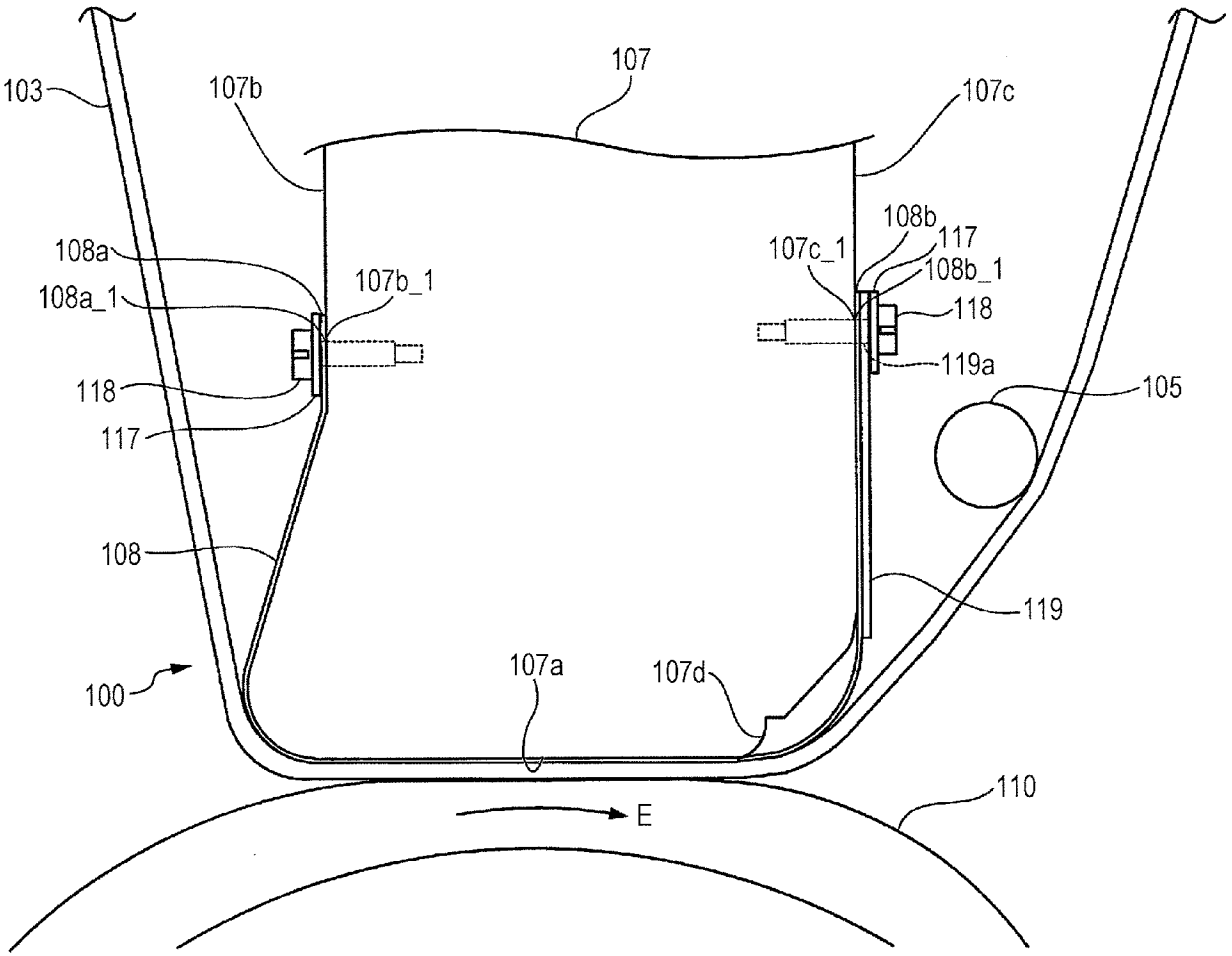
FIG. 3 illustrates an area near a nip region in the fixing device in FIG. 2.

FIG. 3 illustrates an area near the nip region in the fixing device 100 in FIG. 2.

The fixing pad 107 has the attachment surface 107*a* that is attached to the endless belt 103, and two side surfaces as follows. A first side surface 107*b* extends from an upstream end of the attachment surface 107*a* in a moving direction of a portion of the endless belt 103 moving along the attachment surface 107*a* (the direction indicated by arrow E) so as to extend away from the inner surface of the endless belt 103. A second side surface 107*c* extends from a downstream end of the attachment surface 107*a* in the moving direction (the direction indicated by arrow E) so as to extend away from the inner surface of the endless belt 103. The first side surface 107*b* corresponds to an example of a first side surface according to an exemplary embodiment of the present invention. The second side surface 107*c* corresponds to an example of a second side surface according to an exemplary embodiment of the present invention.

Further, an R part 107*d* with a radius ranging from about 1 to 4 mm is provided at the right corner in the drawing of the fixing pad 107, i.e., at the corner at the exit side of the nip region. The R part 107*d* is pushed into the pressure roller 110 and provides a high pressing force at the exit side.

The first side surface 107*b* of the fixing pad 107 has a first screw hole 107*b*_1. The slide sheet 108 has a first end portion 108*a* having a first through hole 108*a*_1.

The first end portion 108*a* of the slide sheet 108 is fixed to the first side surface 107*b* such that a screw 118 penetrates through a flat washer 117 and the first through hole 108*a*_1 of the slide sheet 108 and is inserted into the first screw hole 107*b*_1. A formation portion of the first screw hole 107*b*_1 at the first side surface 107*b* corresponds to an example of a first fixing portion according to an exemplary embodiment of the present invention.

Also, the second side surface 107*c* of the fixing pad 107 has a second screw hole 107*c*_1. The slide sheet 108 has a second end portion 108*b* at a side opposite to the first end portion 108*a*. The second end portion 108*b* has a second through hole 108*b*_1.

A portion of the slide sheet 108 extending from the second end portion 108*b* to a portion corresponding to a lower end of the second side surface 107*c* of the fixing pad 107 is pressed to the second side surface 107*c* by a restriction member 119. The restriction member 119 corresponds to an example of a restriction member according to an exemplary embodiment of the present invention.

A screw 118 penetrates through a flat washer 117, a through hole 119*a* of the restriction member 119, and the second through hole 108*b*_1 of the slide sheet 108, and is inserted into the second screw hole 107*c*_1. Accordingly, the second end portion 108*b* of the slide sheet 108 is fixed to the second side surface 107*c*. A formation portion of the second screw hole 107*c*_1 at the second side surface 107*c* corresponds to an example of a second fixing portion according to an exemplary embodiment of the present invention.

A portion of the slide sheet 108 from the formation portion of the first through hole 108*a*_1 to the formation portion of the second through hole 108*b*_1 of the slide sheet 108 has a length as follows.

The length is larger than a length of a path from the formation portion of the first screw hole 107*b*_1 to the formation portion of the second screw hole 107*c*_1 through the first side surface 107*b*, the attachment surface 107*a*, and the second side surface 107*c* of the fixing pad 107.

The length of the path from the formation portion of the first through hole 108*a*_1 to the formation portion of the second through hole 108*b*_1 of the slide sheet 108 corresponds to an example of a "length from a first end portion to a second end portion" according to an exemplary embodiment of the present invention. The above-described length of the path of the fixing pad 107 corresponds to an example of a "length of a path from a first fixing portion to a second fixing portion through a first side surface, an attachment surface, and a second side surface of an attachment member" according to an exemplary embodiment of the present invention.

When the endless belt 103 moves in the direction indicated by arrow E by the rotation of the pressure roller 110, the slide sheet 108 is pulled by the endless belt 103 in the direction indicated by arrow E. Since the length from the formation portion of the first through hole 108*a*_1 to the formation portion of the second through hole 108*b*_1 is determined as described above, a slack of the slide sheet 108 appears at the exit side of the nip region.

As described above, the portion of the slide sheet 108 extending from the second end portion 108*b* to the portion corresponding to the lower end of the second side surface 107*c* of the fixing pad 107 is pressed to the second side surface 107*c* by the restriction member 119. Owing to this, the slack of the slide sheet 108 is restricted at a position near the formation portion of the second screw hole 107*c*_1 of the fixing pad 107. As shown in FIG. 3, the slack of the slide sheet 108 appears only at the most downstream side in the moving direction of the endless belt 103 (the direction indicated by arrow E) in the contact region with respect to the endless belt 103.

Now, the description for the fixing device 100 with reference to FIG. 3 is finished once, and a comparative example that is compared with the fixing device 100 is described.

Figure 4:
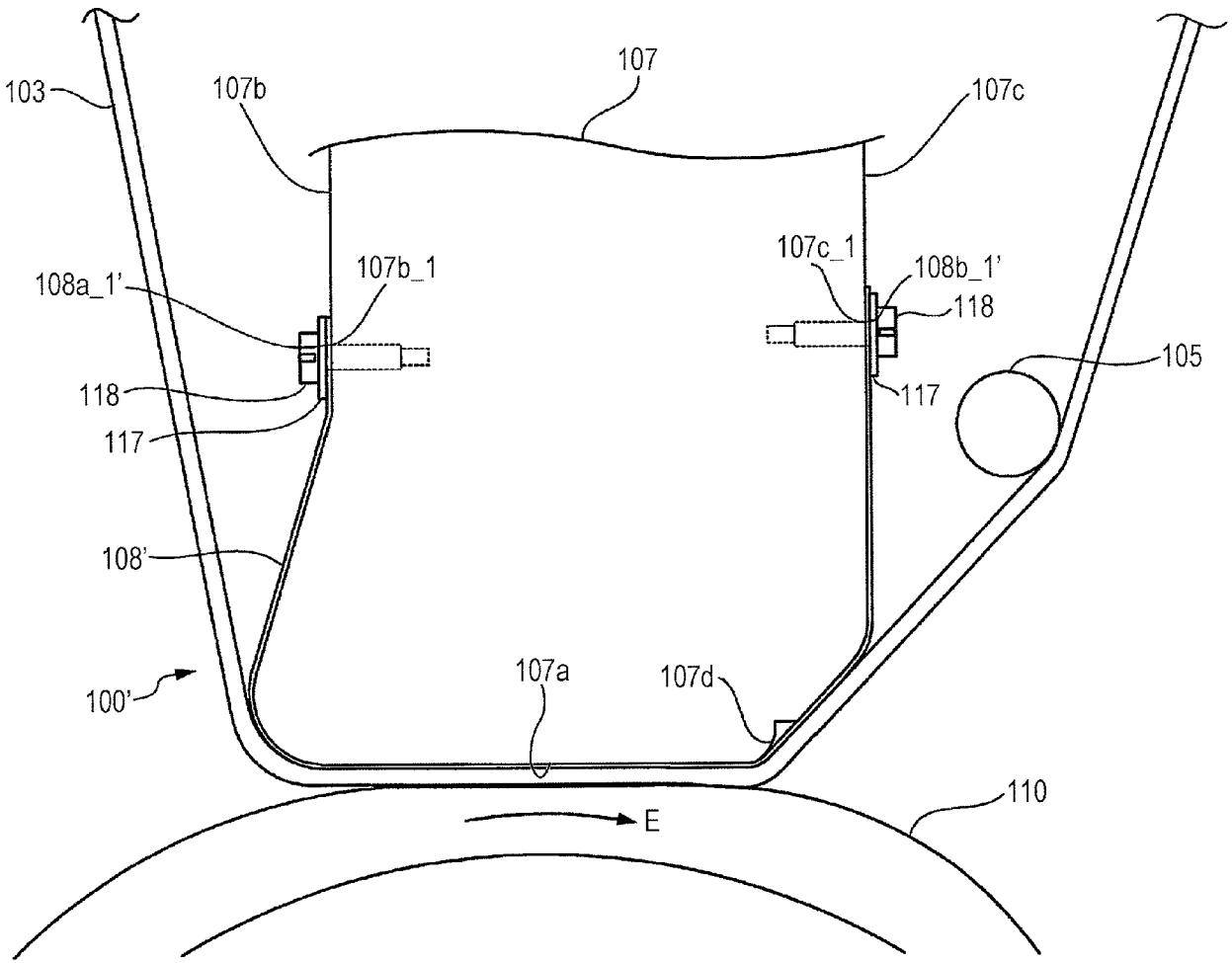
FIG. 4 illustrates an area near a nip region in a fixing device of a comparative example.

FIG. 4 illustrates an area near a nip region in a fixing device 100' of the comparative example.

The fixing device 100' according to the comparative example differs from the fixing device 100 in FIG. 3 in the length of a slide sheet 108' and in that the restriction member 119 shown in FIG. 3 is not provided.

Components shown in FIG. 4 equivalent to the components shown in FIG. 3 refer the same reference signs as those in FIG. 3. The redundant description for the equivalent components is omitted.

In the slide sheet 108' shown in FIG. 4, a path from a formation portion of a first through hole 108*a*_1' to a formation portion of a second through hole 108*b*_1' has a length as follows.

That is, the length is substantially the same length as a length of a path from the formation portion of the first screw hole 107*b*_1 to the second screw hole 107*c*_1 through the first side surface 107*b*, the attachment surface 107*a*, and the second side surface 107*c* of the fixing pad 107. Owing to this, the slide sheet 108' shown in FIG. 4 is fixed to the outer surface of the fixing pad 107 in a form extending along the external shape of the fixing pad 107. As the result, the endless belt 103 has a shape that extends from the attachment surface 107*a* to the corner at the exit side of the nip region and is bent along the external shape of the fixing pad 107.

As described above, the R part 107*d* with the radius ranging from 1 to 4 mm is provided at the corner of the fixing pad 107 at the exit side of the nip region. If the radius of the R part 107*d* is in a range from 1 to 3 mm, a bending stress to the endless belt 103 at the portion with the R part 107*d* attached is large. Hence, if fixing is repeated, fatigue rupture may occur.

For example, when the radius of the R part 107*d* is 2 mm, the thickness of the base member of the endless belt 103 is 85 μm, the thickness of the silicone rubber layer is 500 μm, and the thickness of the release layer is 40 μm, a trial calculation has been obtained such that the possibility of occurrence of fatigue rupture increases if the number of fixed sheets exceeds about 300 kPV. Here, "kPV" represents "×1000 sheets."

In the fixing device 100 in FIG. 3, the length from the formation portion of the first through hole 108*a*_1 to the second through hole 108*b*_1 of the slide sheet 108 is the length that generates the slack at the exit side of the nip region as described above. The slack portion of the slide sheet 108 at the exit side of the nip region is pinched between the R part 107*d* of the fixing pad 107 and the endless belt 103. The pinched slack portion of the slide sheet 108 restricts following property of the endless belt 103 to the R part 107*d*. As the result, the resistance to the above-described fatigue rupture is increased.

For example, when fixing by the fixing device 100 in FIG. 3 is repeated under the same condition as the condition of the trial calculation, a result of an experiment is obtained such that even if the number of fixed sheets reaches about 1000 kPV, the fatigue rupture does not occur.

In the fixing device 100 in FIG. 3, the above-described restriction member 119 restricts the slack of the slide sheet 108 so that the slack is provided only at the most downstream side of the contact region with respect to the endless belt 103 in the moving direction of the endless belt 103 (in the direction indicated by arrow E). Owing to this, major part of the slack of the slide sheet 108 makes contribution to the restriction in following property of the endless belt 103 to the R part 107*d*.

Next, a second exemplary embodiment is described.

A brief configuration of an image forming apparatus according to the second exemplary embodiment is equivalent to the brief configuration of the image forming apparatus 1 according to the first exemplary embodiment shown in FIG. 1. Hence, illustration and description for the brief configuration of the image forming apparatus according to the second exemplary embodiment are omitted.

Figure 5:
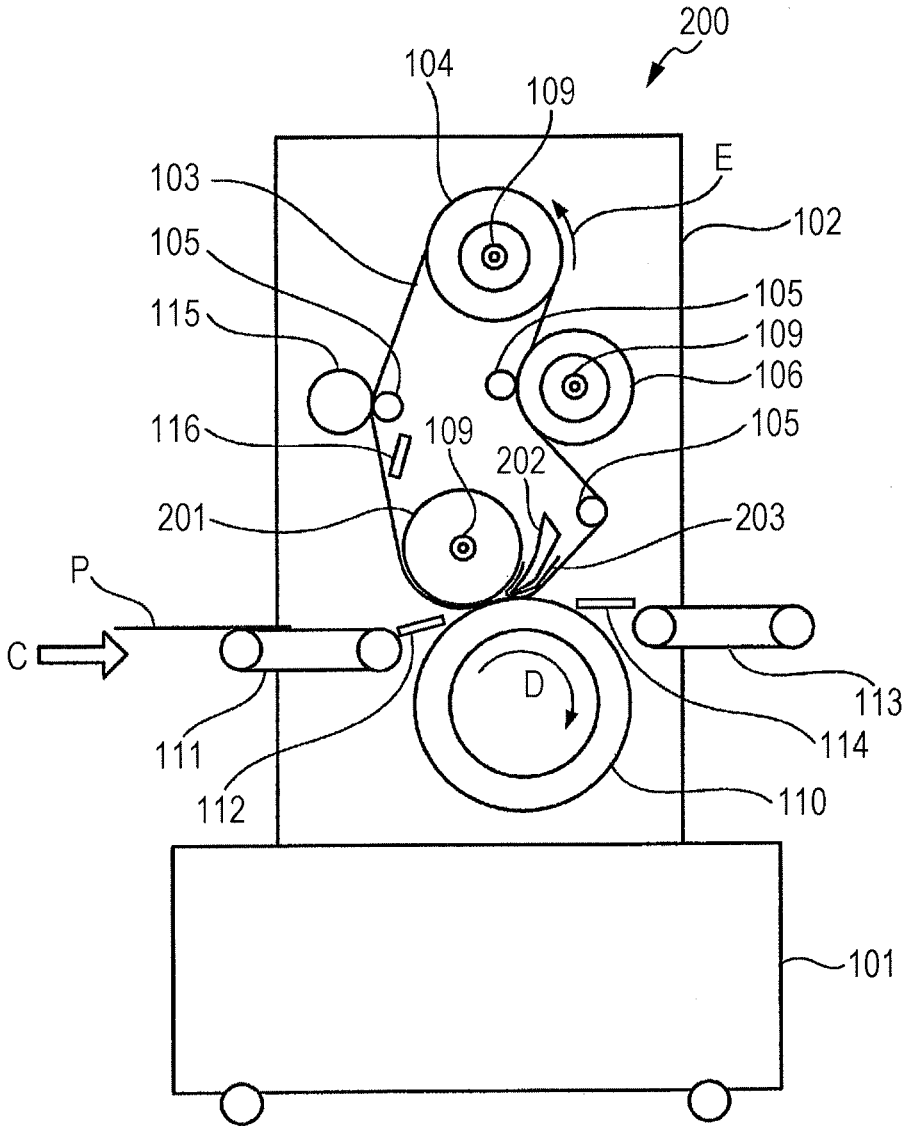
FIG. 5 schematically illustrates a brief inner structure of a fixing device according to a second exemplary embodiment.

FIG. 5 schematically illustrates a brief inner structure of a fixing device 200 according to the second exemplary embodiment.

Components shown in FIG. 5 equivalent to the components of the fixing device 100 according to the first exemplary embodiment shown in FIG. 2 refer the same reference signs as those in FIG. 5. The redundant description for the equivalent components is omitted.

The fixing device 200 shown in FIG. 5 includes a fixing roller 201 and a fixing pad for release 202.

The fixing device 200 shown in FIG. 5 corresponds to a fixing device according to an exemplary embodiment of the present invention. The fixing device 200 also corresponds to a fixing unit included in an image forming apparatus according to an exemplary embodiment of the present invention. Further, the fixing pad for release 202 corresponds to an example of an attachment member according to an exemplary embodiment of the present invention.

The fixing roller 201 is rotatably supported at the frame 102, and supports and applies a tension to the endless belt 103 together with the tension roller 104. The heater 109 that heats the endless belt 103 is embedded in the fixing roller 201.

The fixing pad for release 202 is fixed to the frame 102 at a position at which the fixing pad for release 202 is adjacent to the fixing roller 201 at the downstream side in a passing direction of a sheet P and the fixing pad for release 202 is attached to the inner surface of the endless belt 103.

The pressure roller 110 presses the outer surface of the endless belt 103 while the endless belt 103 is interposed between the pressure roller 110, and both the fixing roller 201 and the fixing pad for release 202.

The fixing pad for release 202 promotes release of the sheet P passing through the nip region from the endless belt 103 by bending the endless belt 103 at the exit side of the nip region so as to extend away from the endless belt 103.

In the fixing device 200 shown in FIG. 5, a slide sheet 203 is fixed to the fixing pad for release 202 as described above while the slide sheet 203 is pinched between the fixing pad for release 202 and the endless belt 103. The slide sheet 203 corresponds to an example of a slide sheet according to an exemplary embodiment of the present invention.

Figure 6:
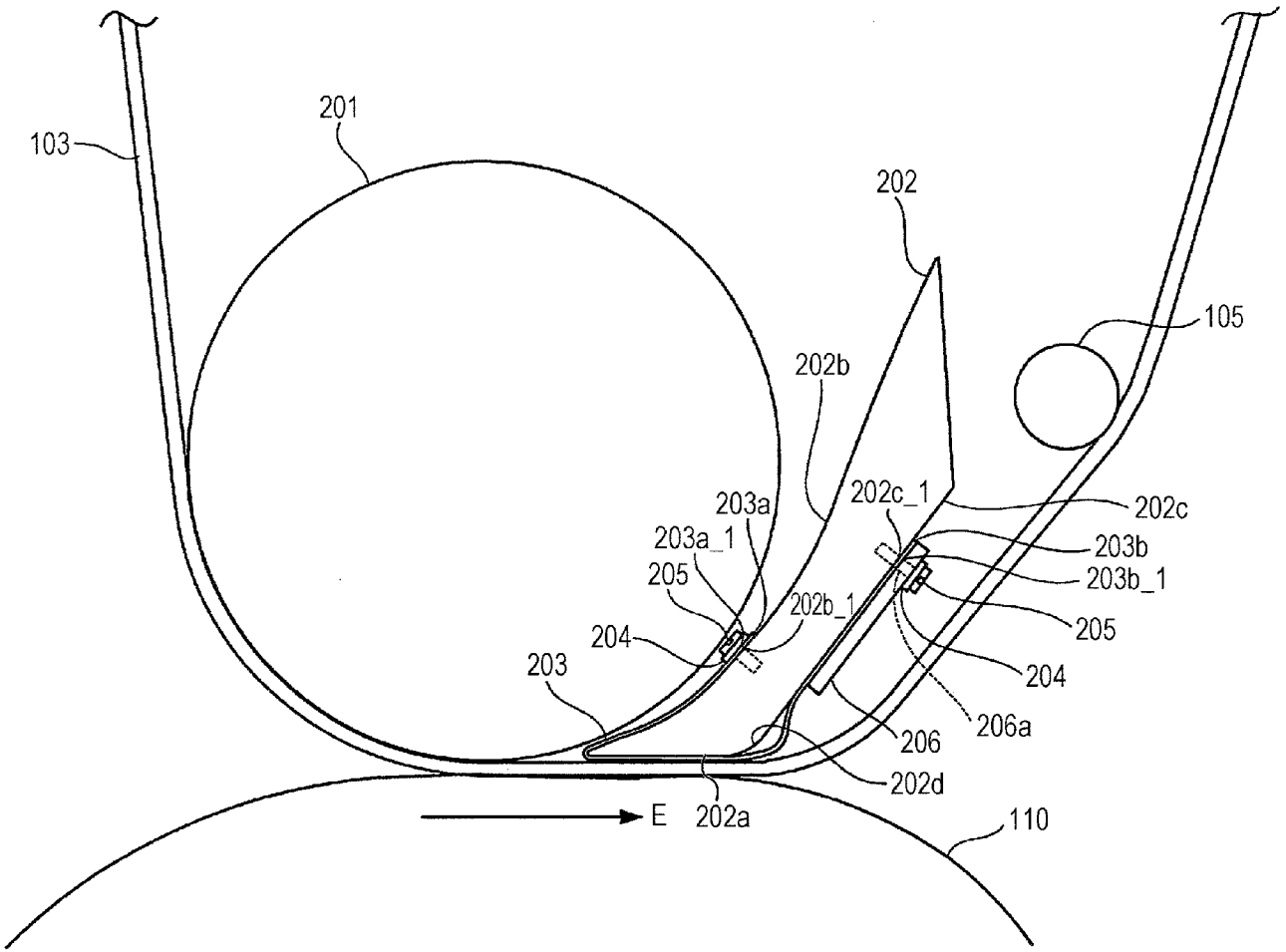
FIG. 6 illustrates an area near a nip region in the fixing device in FIG. 5.

FIG. 6 illustrates an area near the nip region in the fixing device 200 in FIG. 5.

The fixing pad for release 202 has an attachment surface 202*a* that is adjacent to the fixing roller 201 and attached to the endless belt 103, and two side surfaces as follows.

A first side surface 202*b* extends from an upstream end of the attachment surface 202*a* in the moving direction of a portion of the endless belt 103 moving along the attachment surface 202*a* (the direction indicated by arrow E) so as to extend away from the inner surface of the endless belt 103. A second side surface 202*c* extends from a downstream end in the moving direction (the direction indicated by arrow E) of the attachment surface 202*a* so as to extend away from the inner surface of the endless belt 103. The first side surface 202*b* corresponds to an example of a first side surface according to an exemplary embodiment of the present invention. The second side surface 202*c* corresponds to an example of a second side surface according to an exemplary embodiment of the present invention.

Further, an R part 202*d* with a radius ranging from about 1 to 4 mm is provided at the right corner in the drawing of the fixing pad for release 202, i.e., at the corner at the exit side of the nip region. The R part 202*d* is pushed into the pressure roller 110 and provides a high pressing force at the exit side.

The first side surface 202*b* of the fixing pad for release 202 has a first screw hole 202*b*_1. The slide sheet 203 has a first end portion 203*a* having a first through hole 203*a*_1.

The first end portion 203*a* of the slide sheet 203 is fixed to the first side surface 202*b* such that a screw 205 penetrates through a flat washer 204 and the first through hole 203*a*_1 of the slide sheet 203 and is inserted into the first screw hole 202*b*_1. A formation portion of the first screw hole 202*b*_1 at the first side surface 202*b* corresponds to an example of a first fixing portion according to an exemplary embodiment of the present invention.

Also, the second side surface 202*c* of the fixing pad for release 202 has a second screw hole 202*c*_1. The slide sheet 203 has a second end portion 203*b* at a side opposite to the first end portion 203*a*. The second end portion 203*b* has a second through hole 203*b*_1.

A portion of the slide sheet 203 extending from the second end portion 203*b* to a portion corresponding to a predetermined position near a lower end of the second side surface 202*c* of the fixing pad for release 202 is pressed to the second side surface 202*c* by a restriction member 206. The restriction member 206 corresponds to an example of a restriction member according to an exemplary embodiment of the present invention.

A screw 205 penetrates through a flat washer 204, a through hole 206*a* of the restriction member 206, and the second through hole 203*b*_1 of the slide sheet 203, and is inserted into the second through hole 202*c*_1. Accordingly, the second end portion 203*b* of the slide sheet 203 is fixed to the second side surface 202*c*. A formation portion of the second screw hole 202*c*_1 at the second side surface 202*c* corresponds to an example of a second fixing portion according to an exemplary embodiment of the present invention.

A portion of the slide sheet 203 from the formation portion of the first through hole 203*a*_1 to the formation portion of the second through hole 203*b*_1 of the slide sheet 203 has a length as follows.

The length is larger than a length of a path from the formation portion of the first screw hole 202*b*_1 to the formation portion of the second screw hole 202*c*_1 through the first side surface 202*b*, the attachment surface 202*a*, and the second side surface 202*c* of the fixing pad for release 202.

The length of the path from the formation portion of the first through hole 203*a*_1 to the formation portion of the second through hole 203*b*_1 corresponds to an example of a "length from a first end portion to a second end portion" according to an exemplary embodiment of the present invention. The length of the path of the fixing pad for release 202 corresponds to an example of a "length of a path from a first fixing portion to a second fixing portion through a first side surface, an attachment surface, and a second side surface of an attachment member" according to an exemplary embodiment of the present invention.

When the endless belt 103 moves in the direction indicated by arrow E by the rotation of the pressure roller 110, the slide sheet 203 is pulled by the endless belt 103 in the direction indicated by arrow E. Since the length from the formation portion of the first through hole 203*a*_1 to the formation portion of the second through hole 203*b*_1 is determined as described above, a slack of the slide sheet 203 appears at the exit side of the nip region.

As described above, the portion of the slide sheet 203 extending from the second end portion 203*b* to the portion corresponding to the predetermined position near the lower end is pressed to the second side surface 202*c* by the restriction member 206. Owing to this, the slack of the slide sheet 203 is restricted at the position near the formation portion of the second screw hole 202*c*_1 of the fixing pad for release 202. As shown in FIG. 6, the slack of the slide sheet 203 appears only at the most downstream side in the moving direction of the endless belt 103 (the direction indicated by arrow E) in the contact region with respect to the endless belt 103.

The slack portion of the slide sheet 203 at the exit side of the nip region is pinched between the R part 202*d* of the fixing pad for release 202 and the endless belt 103. The pinched slack portion of the slide sheet 203 restricts the following property of the endless belt 103 to the R part 202*d*. As the result, the resistance to the fatigue rupture of the endless belt 103 is enhanced.

In the fixing device 200 in FIG. 6, the above-described restriction member 206 restricts the slack of the slide sheet 203 so that the slack is provided only at the most downstream side of the contact region with respect to the endless belt 103 in the moving direction of the endless belt 103 (in the direction indicated by arrow E). Owing to this, major part of the slack of the slide sheet 203 makes contribution to the restriction in following property of the endless belt 103 to the R part 202*d*.

In any of the above-described first and second exemplary embodiments, the heaters are respectively provided in the tension roller, the fixing pad, the external heat roller, and the fixing roller. However, in the fixing device, for example, a heater that is provided one of the tension roller, the fixing pad, the external heat roller, and the fixing roller may heat the endless belt.

Also, in any of the first and second exemplary embodiments, the tandem color printer is used as an example of an image forming apparatus according to an exemplary embodiment of the present invention. However, the image forming apparatus according to an exemplary embodiment of the present invention may be a rotary color printer in which plural developing units are arranged around the rotation axis, or may be a monochrome printer. Also, the image forming apparatus according to an exemplary embodiment of the present invention is not limited to the printer, and may be a copier, a facsimile, or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a heat assembly comprising:

an endless belt configured to move in a circulation manner and comprising an inner surface and an outer surface, a heat source configured to heat the endless belt, an attachment member comprising:

an attachment surface attached to the inner surface of the endless belt, first and second side surfaces respectively extending from upstream and downstream ends of the attachment surface in a moving direction of a portion of the endless belt moving along the attachment surface and extending away from the inner surface of the endless belt, the first side surface having a first fixing portion, the second side surface having a second fixing portion, and an R part comprising a transition portion having a radius and provided between e attachment surface and the second side surface, the R part provided at an exit side of a nip region, and a slide sheet having first and second end portions that are respectively fixed to the first fixing portion of the first side surface and the second fixing portion of the second side surface, the slide sheet being pinched and extending between the attachment surface of the attachment member and the endless belt, the slide sheet having a larger length from the first end portion to the second end portion than a length of a path of the attachment member extending from the first fixing portion to the second fixing portion through the first side surface, the attachment surface, and the second side surface; and a pressure roller that presses the outer surface of the endless belt to the attachment surface, receives a medium that holds an unfixed toner image between the pressure roller and the endless belt, and fixes the toner image to the medium in cooperation with the heat assembly, wherein the slide sheet is configured to continuously contact the attachment member between the first fixing portion and the R part of the attachment member.

2. The fixing device according to claim 1, further comprising a restriction member configured to restrict a slack at a portion of the slide sheet near the second fixing portion and hence configured to cause a portion at a most downstream side of a contact region of the slide sheet with respect to the endless belt in the moving direction of the endless belt to be slacked.

3. The fixing device according to claim 2, wherein the restriction member extends from the second fixing portion to near a slack of the slide sheet along with the second side surface and contacts to the slide sheet so as to nip the slide sheet between the restriction member and the attachment member.

4. The fixing device according to claim 1, wherein a length of the slide sheet between R part and the second fixing portion is larger than a length along an outer surface of the attachment member between R part and the second fixing portion.

5. An image forming apparatus, comprising:

an image forming unit configured to form an electrostatic latent image, to form a toner image by developing the electrostatic latent image with a toner, and to pass the toner image to a medium; and a fixing unit configured to fix the unfixed toner image passed to the medium onto the medium, wherein the fixing unit comprising:

a heat assembly comprising:

an endless belt configured to move in a circulation manner and comprising an inner surface and an outer surface, a heat source configured to heat the endless belt, an attachment member comprising:

an attachment surface attached to the inner surface of the endless belt, first and second side surfaces respectively extending from upstream and downstream ends of the attachment surface in a moving direction of a portion of the endless belt moving along the attachment surface and extending away from the inner surface of the endless belt, the first side surface having a first fixing portion, the second side surface having a second fixing portion, and an R part provided between the attachment surface and the second side surface, the R part provided at an exit side of a nip region, and a slide sheet having first and second end portions that are respectively fixed to the first fixing portion of the first side surface and the second fixing portion of the second side surface, the slide sheet being pinched and extending between the attachment surface of the attachment member and the endless belt, the slide sheet having a larger length from the first end portion to the second end portion than a length of a path of the attachment member extending from the first fixing portion to the second fixing portion through the first side surface, the attachment surface, and the second side surface; and a pressure roller that presses the outer surface of the endless belt to the attachment surface, receives a medium that holds an unfixed toner image between the pressure roller and the endless belt, and fixes the toner image to the medium in cooperation with the heat assembly, wherein the slide sheet is configured to continuously contact the attachment member between the first fixing portion and the R part of the attachment member.

* * * * *